US005990851A

United States Patent [19]

Henderson et al.

[11] Patent Number: 5,990,851

[45] Date of Patent: Nov. 23, 1999

[54] SPACE DEPLOYABLE ANTENNA STRUCTURE TENSIONED BY HINGED SPREADER-STANDOFF ELEMENTS DISTRIBUTED AROUND INFLATABLE HOOP

[75] Inventors: Philip J. Henderson; Richard A. Deadwyler, both of Palm Bay, Fla.

[73] Assignee: Harris Corporation, Melbourne, Fla.

[21] Appl. No.: 09/009,008

[22] Filed: Jan. 16, 1998

[51] Int. Cl.[6] ..... H01Q 15/20

[52] U.S. Cl. ..... 343/915; 343/840; 343/882; 343/881

[58] Field of Search ..... 343/915, 840, 343/881, 880, 897, DIG. 2, 709, 912; 342/5, 6, 10

[56] References Cited

U.S. PATENT DOCUMENTS

| | | | |
|---|---|---|---|
| 3,220,004 | 11/1965 | Gillespie | 343/915 |
| 3,281,849 | 10/1966 | Andreasen | 343/753 |

(List continued on next page.)

OTHER PUBLICATIONS

"The AstroMesh Deployable Reflector" by Mark W. Thomson, Spacecraft Technologies, International Mobile Satellite Conferece, pp. 393–398.

"Europeans Strive to Commercialize Space Designs", by Peter B. DeSelding, Space News, Jun. 16–22, 1997, pp. 6 and 16.

"Low Cost Large Space Antennas" by Artur B. Chmielewski et al, Spacecraft Technologies, International Mobile Satellite Conference, 1997, pp. 375–380.

"Inflatable Structures Technology Development Overview", by Dr. Costa Cassapakis and Dr. Mitch Thomas, AIAA 1995 Space Programs and Technologies Conference, Sep. 26–28, 1995, pp. 1–10.

"Space Inflatables", one page document by ILC Dover, Inc. Frederica DE 19946.

"Pressurized Antennas for Space Radars" by M. Thomas and G.J. Friese, AIAA Sensor Systems For The 80's Conference, Dec. 2–4, 1980, pp. 65–71.

"Inflatable Arm Segments May Lighten Shuttle's Manipulator System" by Lyle H. McCarty, Aerospace –Design News, pp. 150–152, Apr. 9, 1990

Bound Booklet Entitled "Mesh Antenna Overview", Harris Corporation, Oct. 1995.

*Primary Examiner*—Don Wong
*Assistant Examiner*—James Clinger
*Attorney, Agent, or Firm*—Charles E. Wands

[57] ABSTRACT

An antenna structure, such as an antenna reflector, comprises a collapsible mesh and catenary tie/cord attachment structure, retained in tension by a plurality of variable geometry spreader-standoffs connected to an inflatable tubular support hoop. The standoffs decouple the energy-focusing geometry of the antenna surface from the hoop, so as to reduce the sensitivity of the shape of the surface to variations in the shape of the tubing. Each spreader-standoff is connected to the hoop at a hinge joint of a pair of spreader-standoff elements, by a radial connection element retained in tension by the adjoining tubing. The hinge joint of a respective spreader-standoff pair is adjacent to an inner diameter side of the hoop, while distal locations of the spreader-standoff elements are located beyond an outer diameter side of the inflated hoop. As a consequence, the inflatable hoop may have a relatively small cross-section, which reduces its size and weight, as long as it is capable of effectively maintaining its intended configuration when inflated/deployed. Since the only connection between a respective pair of spreader-standoff elements and the tubular support hoop is through a radial connection element at the hinge joint, the inflatable hoop is self-centering, with radial loading effectively maintaining the antenna in its deployed state.

20 Claims, 4 Drawing Sheets

U.S. PATENT DOCUMENTS

| | | | |
|---|---|---|---|
| 4,191,604 | 3/1980 | MacTurk | 156/242 |
| 4,251,819 | 2/1981 | Vickland | 343/882 |
| 4,364,053 | 12/1982 | Hotine | 343/915 |
| 4,475,109 | 10/1984 | Dumas et al. | 343/709 |
| 4,672,389 | 6/1987 | Ulry | 343/915 |
| 4,741,609 | 5/1988 | Sallis | 350/608 |
| 4,755,819 | 7/1988 | Bernasconi et al. | 343/915 |
| 4,804,972 | 2/1989 | Schudel | 343/840 |
| 4,825,225 | 4/1989 | Waters et al. | 343/881 |
| 5,166,696 | 11/1992 | Rupp et al. | 343/711 |
| 5,202,689 | 4/1993 | Bussard et al. | 342/10 |
| 5,527,001 | 6/1996 | Stuart | 244/158 R |
| 5,680,145 | 10/1997 | Thomson et al. | 343/915 |

SPACE DEPLOYABLE ANTENNA STRUCTURE TENSIONED BY HINGED SPREADER-STANDOFF ELEMENTS DISTRIBUTED AROUND INFLATABLE HOOP

FIELD OF THE INVENTION

The present invention relates in general to antenna assemblies, such as space-deployable antenna structures, such as, but not limited to, antenna reflectors. The invention is particularly directed to a new and improved support architecture having an arrangement of tensioned ties and cords that are attached to an inflated support structure, such as a tubular hoop, by means of a plurality of variable geometry spreader-standoffs. These spreader-standoffs effectively decouple the energy-focusing geometry of the surface of the antenna structure from its adjoining inflatable support structure, while still using radial-loading support capability of the inflated support structure to fully deploy the antenna surface to its intended shape, and reducing its sensitivity to variations in the shape of the tubular hoop.

BACKGROUND OF THE INVENTION

Among the variety of antenna assemblies (e.g., reflectors) that have been proposed for airborne and spaceborne applications are those unfurlable structures which employ an inflatable structure that forms a 'stressed skin' type of reflective surface. In assemblies proposed to date, non-limiting examples of which are described in U.S. Pat. Nos. 4,364,053 and 4,755,819, the inflatable structure itself often serves as the reflective surface of the antenna. For this purpose, the inflatable material has a preformed reflective shape, so that, once fully inflated, its surface will assume the desired antenna geometry. A significant drawback to such structures is the fact that should there be a change in inflation pressure, most notably a decrease in pressure over time, the contour of the support structure and therefore that of the reflective surface itself, will change from the intended antenna profile, thereby impairing the energy gathering and focussing properties of the antenna.

SUMMARY OF THE INVENTION

In accordance with the present invention, this problem is effectively remedied by an antenna focussing surface support architecture having an arrangement of tensioned ties and cords, that are attached to an inflatable support structure by a plurality of variable geometry spreader-standoffs. The antenna itself may comprise a collapsible, generally parabolic, tensionable material, such as a conductive knit mesh, which is supported and retained in tension by a reduced size and weight inflatable support structure, such as a generally hoop-shaped inflatable tubular membrane, that can be either rotationally symmetric about the boresight axis of the antenna, or comprised of straight tube segments joined together to form a hoop.

The variable geometry spreader-standoffs decouple the energy-focusing geometry of the antenna surface from the inflatable support structure, reducing the sensitivity of the surface contour to variations in the shape of the tubular support, such as may be caused by in-orbit thermal effects. As a consequence, the configuration and energy focussing functionality of the antenna do not depend upon using a support structure of a particular shape or size. This allows the use of a smaller tubular support, thereby decreasing the threat of impact of in-orbit foreign matter, which might otherwise reduce the lifetime of the inflatable support.

The support tubing may be inflated to a pressure that is slightly higher than that necessary to fully inflate the tubing and place the tensionable antenna material and its associated tie/cord structure in tension. This elevated pressure will maintain the support structure inflated, and will allow for pressure variations that are insufficient to permit the inflated tubing to deform to such a degree as to relax the tension in the antenna mesh and its tensioning tie/cord structure.

The tensionable tie/cord structure may comprise a collapsible catenary network of respective vertical, cross, and circumferential tensioning ties, cords, tapes and the like, and a tensionable radial cord structure distributed around the inflatable support structure and supported in tension beneath/adjacent to the antenna mesh. The antenna mesh and the tensioning ties and cords of the tensionable tie/cord structure are preferably made of a lightweight, thermally stable material, such as quartz or graphite bundles. This facilitates stowing the antenna and its associated tensioning structure in a compactly furlable state, while enabling the antenna surface material and tie structure to readily unfurl into a predetermined highly stable geometry (e.g., parabolic) antenna, once the tubular hoop support membrane becomes inflated.

Each spreader-standoff is coupled to the inflatable support tubing at a hinge joint of a pair of spreader-standoff elements, by means of a radial connection element that is retained in tension by the adjoining inflatable support structure. The lengths of the spreader-standoff elements are such that they effectively span the inflated tubing, thereby making their geometry not dependent upon that of the tubing.

The hinge joint of a respective spreader-standoff pair is located adjacent to an inner diameter side of the tubing, while generally distal attachment locations of the spreader-standoff elements are located beyond an outer diameter side of the inflated tubing. As a consequence, the inflatable tubing may have a relatively small cross-section, which reduces its size and weight, as long as it is capable of effectively maintaining its intended configuration when inflated/deployed. Since the only connection between a respective pair of spreader-standoff elements and the tubular support hoop is through a radial connection element at the hinge joint, the antenna is self-centering, with the radial loading effectively maintaining the antenna in its deployed state.

The antenna mesh, the cross-connect cords and the hoop cords of the tie/cord structure are attached to distal location of one spreader-standoff element, while the distal location of the other spreader-standoff element is attached to the cross-connect cords and the hoop cords of the tie/cord structure. Because the spreader-standoff elements are connected to the antenna mesh and the tie/cord structure, an increase in separation therebetween causes the hinged spreader-standoff elements of each spreader-standoff pair to open or become spread apart about the axis of their hinge joint, causing the antenna to unfurl to its intended shape. The extent to which the hinged spreader-standoff elements are allowed to open is constrained by cross-connect cords, and vertical perimeter ties or cords.

During inflation of the support tubing, the antenna mesh and the tie/cord structure will eventually reach an unfurled/deployed point at which they are tensioned by the hinged spreader-standoff elements of the tensioning attachment structure. Because spreading apart of the hinged spreader-standoff elements is constrained by the cross-connect cords and vertical perimeter ties, the vertical ties are placed in tension. Since they are connected to the attachment locations of the hinged spreader-standoff elements, the antenna mesh and the tie/cord structure are also placed in tension as intended.

Thus, in the antenna's deployed state, each of the spreader-standoff elements is placed in compression, and the forces acting on the tensioning attachment structure are balanced. The resultant radial loading through the radial connection elements maintains the antenna mesh and attendant tie/cord structure in their deployed and tensioned geometry.

DETAILED DESCRIPTION

Figure 1:
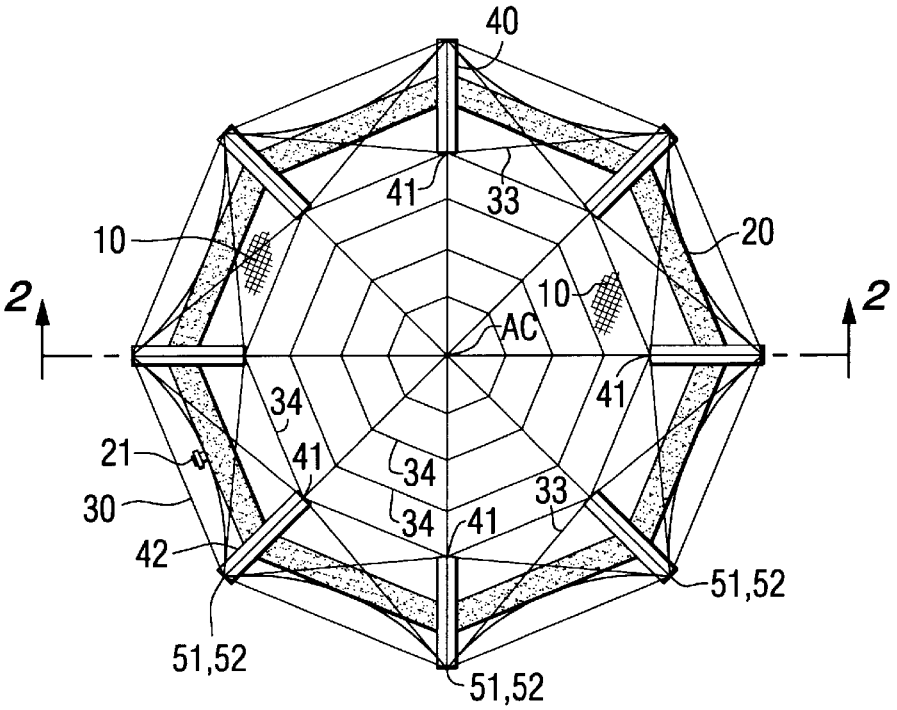
FIG. 1 is a diagrammatic plan view of a space-deployable antenna in accordance with the present invention.
Figure 2:
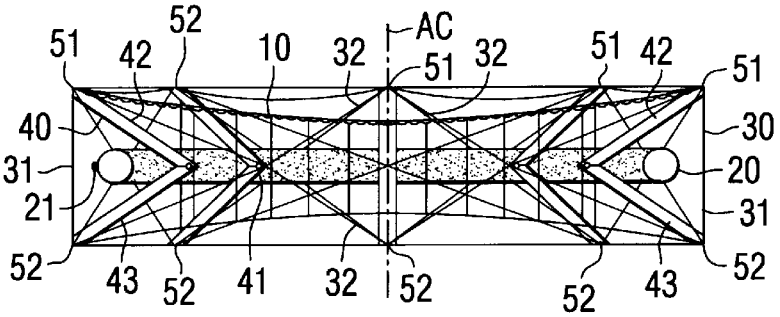
FIG. 2 is a cross-sectional illustration taken through section lines 2—2 of FIG. 1.

Attention is initially directed to FIG. 1, which is a diagrammatic plan view of a space-deployable antenna in accordance with the present invention, and FIG. 2, which is a cross-sectional illustration taken through section lines 2—2 of FIG. 1, which contains an axis of rotation or boresight AC. As shown therein, the reflector surface of the antenna comprises a collapsible, generally parabolic, tensionable material 10, such as but not limited to a conductive mesh material, that is generally rotationally symmetric about the boresight axis AC, but may also be asymmetric for shaped reflector surfaces, and which is supported and retained in tension by a support structure 20 and an associated tensionable tie/cord structure 30. When used to deploy a space-deployable antenna, support structure 20 may comprise a generally circular, or hoop-shaped inflatable tubular membrane, which is generally rotationally symmetric about axis AC, but may alternatively be comprised of straight segments.

As described above, a significantly advantageous structural feature of the antenna of the present invention is the fact that the hinged spreader-standoffs of an adjacent tensioning attachment structure 40, through which each of the antenna mesh 10 and its associated tie/cord structure 30 are coupled to the inflatable tubular support 20, are allowed to flex or rotate relative to each other, and thereby maintain the antenna 10 and the backing tie/cord structure 30 in tension, while accommodating minor variations in the (manufactured) shape of the tubular support membrane 20.

As a consequence, the configuration and energy focussing functionality of the antenna do not depend upon using a support structure of a particular shape or size. This means that, for the case of a tubular, hoop-shaped inflatable membrane as the support structure for a space deployable antenna, the cross-sectional dimensions of the inflatable tubing may vary to meet launch payload and stowage volume constraints. Thus, the inflatable tubing 20 may have a relatively small cross-section, as long as it is capable of effectively maintaining its (generally toroidal in the case of a tubular hoop) configuration when deployed. Since the surface contour of the antenna mesh 10 is effectively decoupled from the inflatable support structure 20, the geometry of the antenna enjoys reduced sensitivity to in-orbit thermal effects, such as temperature gradients causes by spacecraft shadowing. Moreover, a smaller tubular support hoop decreases the threat of impact of in-orbit debris and micrometeroids, which may reduce the lifetime of the inflatable structure.

In its deployed state, the support tubing 20 may be inflated to a pressure that is slightly greater than that necessary to fully inflate the tubing and place the tensionable antenna material and its associated tie/cord structure 30 in tension. This elevated pressure will maintain the (tubular) support structure 20 inflated, and will allow for pressure variations (drops) that are insufficient to permit the inflated support membrane to deform to such a degree as to relax the tension in the antenna surface 10 and tie/cord structure 30.

As described above, the tensionable surface that forms the antenna 10 may comprise a mesh-configured material which, when placed in tension, forms a focusing (e.g., reflective) surface for incident (electromagnetic) energy, such as radio waves. As a non-limiting example, such mesh-configured material may comprise a lightweight, electrically conductive knit mesh of thin wire, having mechanical properties that are selected in accordance with the physical parameters of the antenna's deployed application. Where the reflective surface is to be employed in other applications, such as a solar energy concentrator, the tensionable reflective material may have a generally continuous (rather than a mesh) surface. For space-deployed radio wave reflector applications, the use of a mesh is preferable as it further reduces stowage weight and volume.

The inflatable tubular membrane of the adjoining inflatable support structure 20 may comprise a pliable laminate structure, made of multiple layers of sturdy flexible material, such as Kevlar and Mylar, that are readily collapsible for compact volume stowage upon a launch vehicle, such as the space shuttle. In the course of deployment, the inflatable tubing 20 may be inflated from an inflation source, such as a source of pressurized gas, coupled to an fluid inflation port 21 located at a readily accessible outer diameter surface region of the tubing that facilitates deployment. Alternatively, the inflatable hoop 20 may be filled with a material (such as mercuric oxide powder, as a non-limiting example) that readily sublimes into a pressurizing gas, filling the interior volume of the hoop, and thereby causing the inflatable tubing 20 to expand from an initially furled or collapsed/stowed state to its fully deployed toroid or hoop-shaped state.

Figure 3:
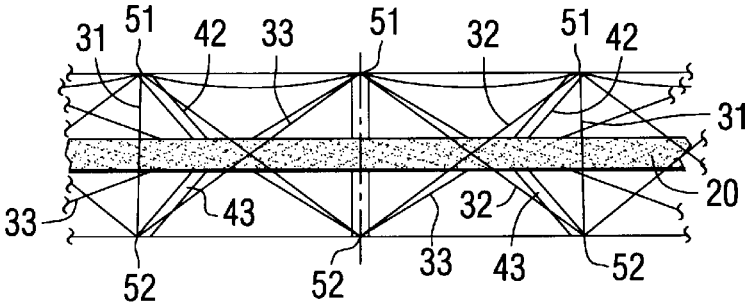
FIG. 3 is a slightly enlarged diagrammatic side view of a portion of FIG. 1.

The tensionable tie/cord structure 30 may comprise a collapsible catenary network of respective vertical, cross, and circumferential tensioning ties, cords or tapes 31, 32/33 and 34 and a tensionable radial cord structure 30, arranged around and crossing over and under the inflatable hoop 20, as shown, and configured to be supported in tension beneath or adjacent to the antenna mesh 10. As shown diagrammatically in FIG. 3, which is a slightly enlarged side view of a portion of FIG. 1, cross-connections (e.g., graphite cords) 32 interconnect distal ends 51 and 52 of adjacent hinged spreader-standoff elements 42, while cross-connections 33 interconnect distal ends 51 and 52 to hinge joints 41 of adjacent hinged spreader-standoff elements 42 of the tensioning attachment structure 40. Also, circumferential hoop cords 34 are connected between adjacent hinged standoff elements.

The tensioning ties and cords of the tensionable tie/cord structure 30 are preferably made of a lightweight, thermally stable material, such as bundled graphite or quartz fiber. Because the tie/cord structure 30 is made of such a material, the entire antenna structure and its associated tensioning structure is compactly furlable in its non-deployed, stowed state, yet readily unfurls into a predetermined, highly stable geometry (e.g., parabolic) antenna, once the tubular hoop support membrane 20 becomes inflated.

As described briefly above, the antenna architecture of the present invention is configured, so as to effectively decouple the energy-focusing geometry of the tensionable antenna surface 10 from its adjoining inflatable support structure 20, while still using the support capability of the inflatable tubing to fully deploy the reflective surface 10 to an intended (generally parabolic) geometry. For this purpose, a tensioning attachment structure 40 comprised of a plurality of hinged spreader-standoffs is connected to the tensionable antenna reflector mesh 10 and its associated tie/cord structure 30.

Figure 4:
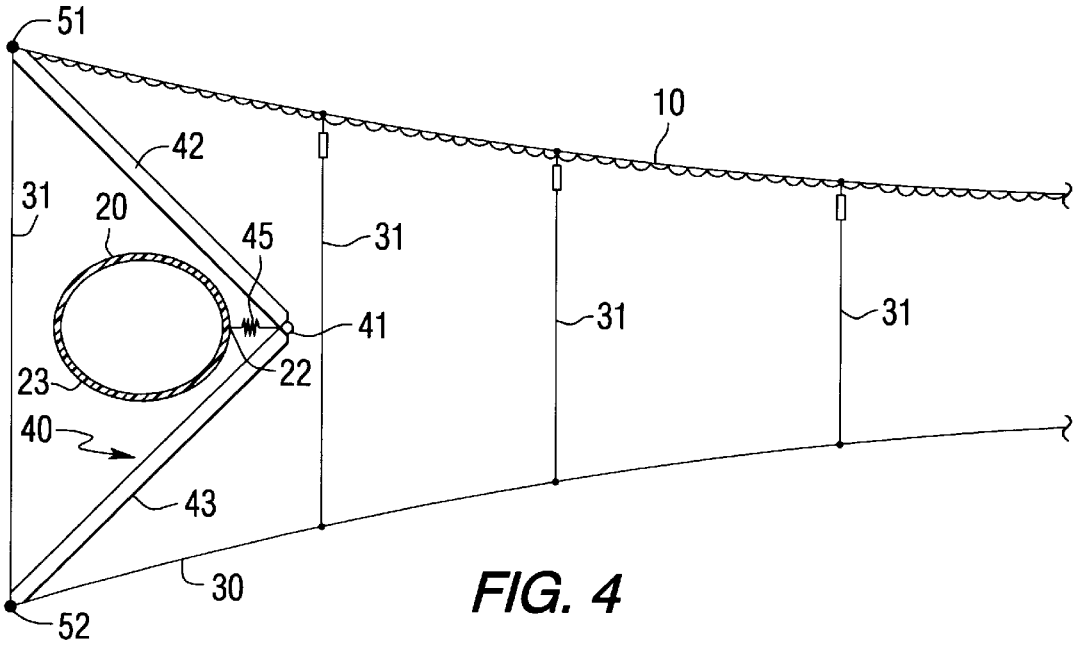
FIG. 4 is an enlarged partial sectional view of the antenna shown in FIG. 1.
Figure 5:
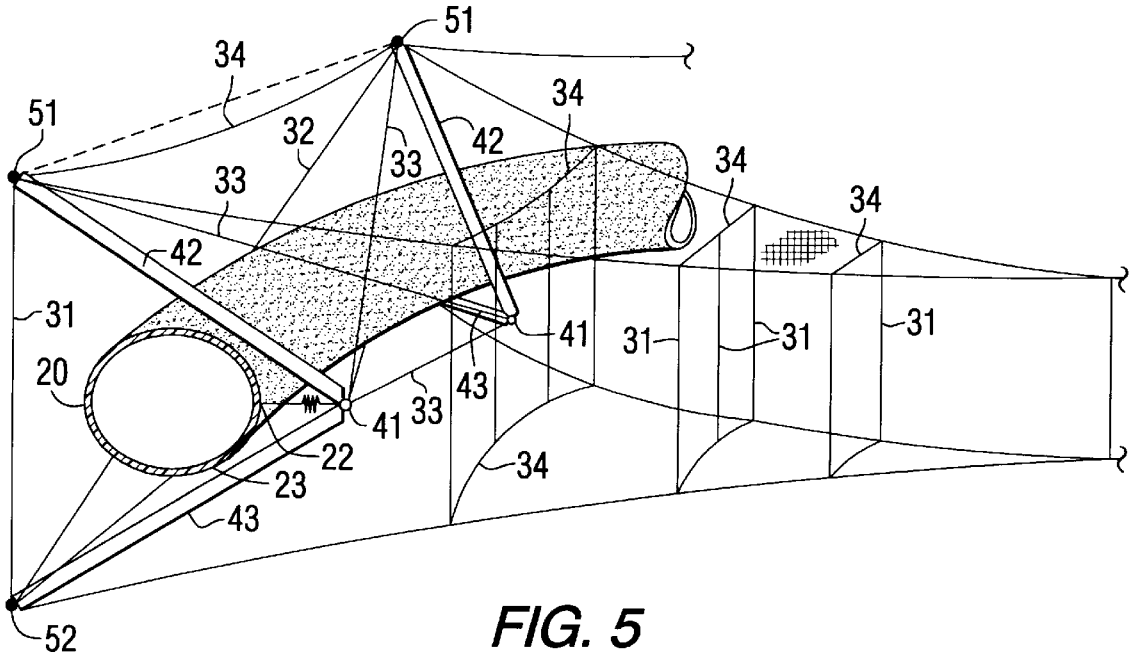
FIG. 5 is an enlarged partial perspective view of the antenna shown in FIG. 1.

As further shown in the enlarged partial sectional view of FIG. 4 and the enlarged partial perspective view of FIG. 5, the spreader-standoffs are distributed around and are coupled to the hoop-shaped inflatable support tubing 20. This coupling is effected at hinge joints 41 of a pair of spreader-standoff elements 42 and 43, by means of connection elements 45, such as rods, cords, springs and the like, that are connected to and retained in tension by the adjoining inflatable support structure 20. A respective connection member 45 is attached to a connection location 22 on the inner diameter surface 23 of the inflatable tubing hoop structure 20.

Figure 6:
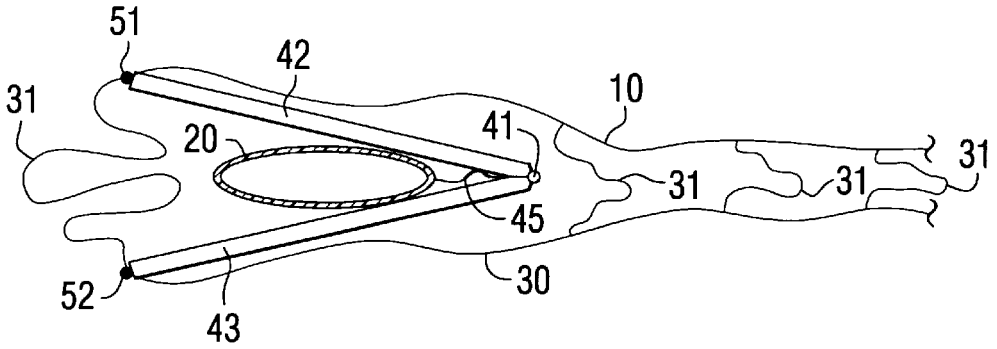
FIGS. 6, 7 and 8 show respective stages of deployment of the antenna of FIG. 1.
Figure 7:
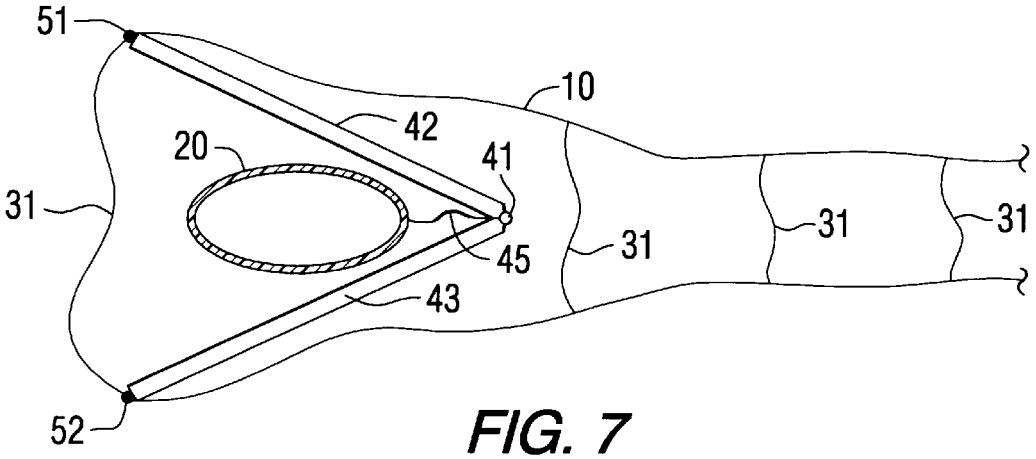
Figure 8:
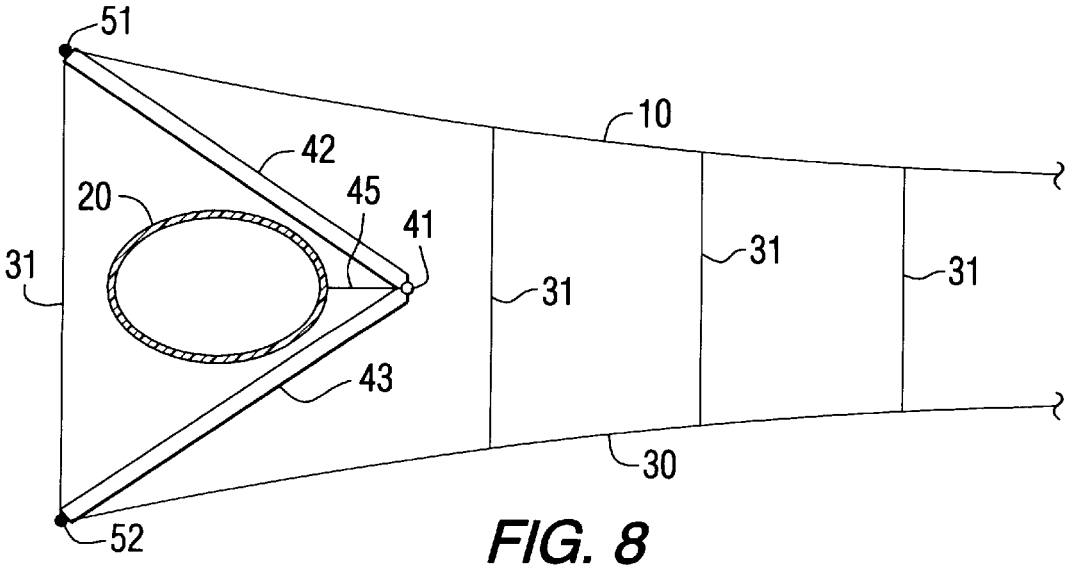

As further shown diagrammatically in FIGS. 6, 7 and 8, a respective connection element 45 is placed in tension between the inflatable tubing 20 and a hinge joint 41, in the course of inflation of the support tubing 20, which increases the diameter of the hoop 20. As shown in FIG. 6, the spreader-standoff elements 42 and 43 readily close or collapse toward one another about hinge joint 41, to facilitate compact stowage of the antenna. In addition, the fact that the spreader-standoff elements 42 and 43 are hinged to one another at the connection point 41 to the hoop enables the spreader-standoffs to flex relative to and thereby accommodate slight variations in the geometry of the adjoining inflatable support structure 20.

More particularly, as shown in FIG. 4, first and second spreader-standoff elements 42 and 43 extend from and are rotatable about an axis of the hinge joint 41 therebetween. The lengths of the spreader-standoff elements 42 and 43 are dimensioned relative to the (cross-sectional) size of the support tubing 20, such that the spreader-standoff elements effectively 'span' the hoop, with the hinge joint 41 of a respective spreader-standoff pair located adjacent to an inner diameter side of the tubing 20, while generally distal attachment locations 51 and 52 of the spreader-standoff elements 42 and 43 are located beyond an outer diameter side of the tubing 20. As pointed out above, this means that the inflatable tubing 20 may have a relatively small cross-section, thereby reducing its size and weight, as long as it is capable of effectively maintaining its intended configuration when deployed. Moreover, since the only connection between a respective pair of spreader-standoff elements 42 and 43 and the tubular support hoop 20 is through a connection element 45 at the hinge joint 41, the hoop 20 is self-centering, with radial loading via connection element 45 effectively maintaining the antenna in its deployed state (once the tubular hoop 20 has been inflated).

As described above, the antenna mesh 10, the cross-connect cords 32/33 and the hoop cords 34 of the tie/cord structure 30 are attached to distal location 51 of the first spreader-standoff element 42, while the distal location 52 of the second spreader-standoff element 43 is attached to the cross-connect cords 32/33 and the hoop cords 34 of the tie/cord structure 30. Because the spreader-standoff elements 42 and 43 are connected (at attachment locations 51 and 52) to the antenna mesh 10 and the tie/cord structure 30, respectively, an increase in separation thereof causes the hinged spreader-standoff elements 42 and 43 of each spreader-standoff pair to open or become spread apart about the axis of the hinge joint 41, as the tubular hoop 20 is inflated—causing the antenna to unfurl, as shown in FIGS. 6–8. The extent to which the hinged spreader-standoff elements 42 and 43 are allowed to open is constrained by the cross-connect cords 32/33, and vertical perimeter ties or cords 31, each interconnecting distal attachment locations 51 and 52 of a respective hinged spreader-standoff element.

Figure 9:
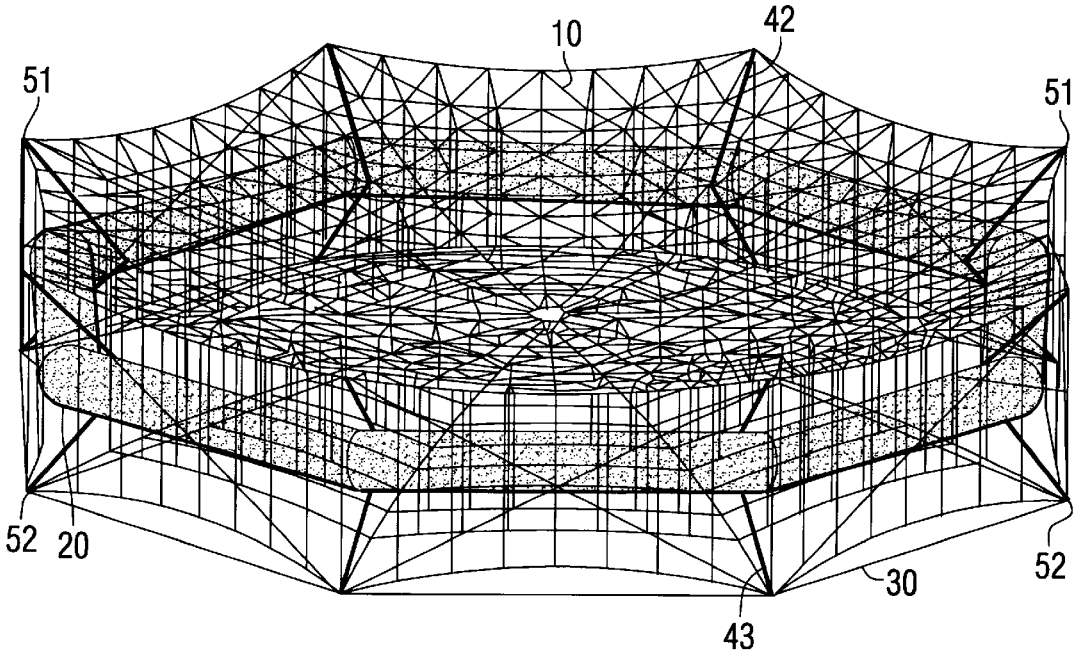
FIGS. 9 and 10 are perspective and side views, respectively, of a fully deployed and tensioned antenna in accordance with the invention.
Figure 10:
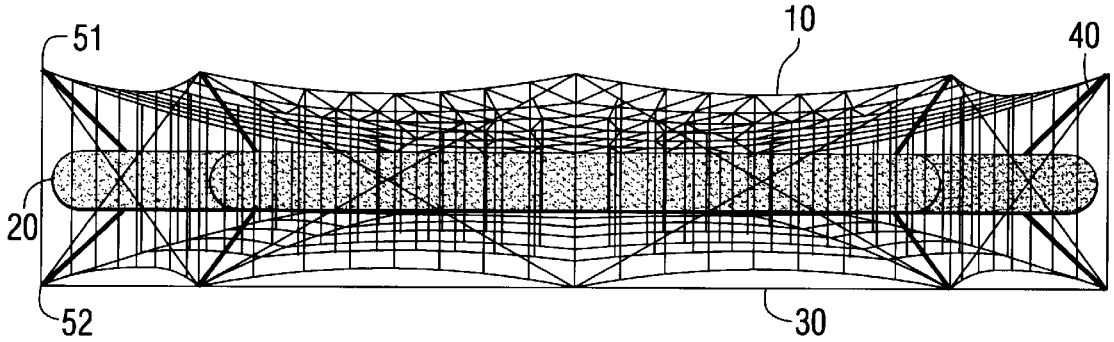

Eventually, as shown in the simplified partial side view of FIG. 8, and shown more fully in the perspective and side views of FIGS. 9 and 10, respectively, the antenna mesh 10 and the tie/cord structure 30 will reach an unfurled/deployed point at which they are fully deployed and tensioned by the hinged spreader-standoff elements 42 and 43 of the tensioning attachment structure 40. Because spreading apart of the hinged spreader-standoff elements 42 and 43 is constrained by the cross-connect cords 32/33 and vertical perimeter ties or cords 31, the vertical ties 31 become placed in tension when the support tubing 20 becomes inflated sufficiently to place a respective connection element 45 in tension between the inflatable tubing 20 and a spreader-standoff hinge joint 41. Being connected to the attachment locations 51 and 52 of the hinged spreader-standoff elements, the antenna mesh 10 and the tie/cord structure 30 are also placed in tension as intended. This means that, in the antenna's deployed state, each of the spreader-standoff elements 42 and 43 is placed in compression, and the forces acting on the tensioning attachment structure 40 are balanced. The resultant radial loading through the connection element 45 described above maintains the antenna mesh 10 and its attendant tie/cord structure in their deployed and tensioned geometry.

As will be appreciated from the foregoing description, the above discussed geometry dependency shortcoming of conventional inflated antenna structures is effectively remedied by the antenna architecture of the present invention, which essentially isolates or decouples the geometry of the antenna surface from the contour of the inflatable support structure, while still using the support capability of the inflatable structure to deploy the antenna. The tensioning tie and cord support structure in combination with the spreader-standoffs maintains the desired geometry of a generally mesh-configured reflective surface of the antenna, while allowing for pressure and temperature variations within the inflated support structure.

While I have shown and described an embodiment in accordance with the present invention, it is to be understood that the same is not limited thereto but is susceptible to numerous changes and modifications as are known to a person skilled in the art, and I therefore do not wish to be limited to the details shown and described herein, but intend to cover all such changes and modifications as are obvious to one of ordinary skill in the art.

What is claimed:

1. An antenna structure comprising:

an inflatable support structure;

a tensionable material configured to form a focusing surface for energy incident thereon;

an attachment structure coupled to said tensionable material; and a plurality of variable geometry standoffs arranged in a prescribed distribution relative to said inflatable support structure, and being coupled to said inflatable support structure, said tensionable material and said attachment structure in such a manner as to effectively decouple energy-focusing geometry of said focusing surface from said inflatable support structure, while still using support capability of said inflatable support structure to deploy said antenna, effectively reducing the sensitivity of the shape of said focusing surface to variations in the shape of said inflatable support structure.

2. An antenna structure according to claim 1, wherein a respective variable geometry standoff comprises first and second standoff elements extending from a hinge joint therebetween, said first standoff element being coupled to said tensionable material, said second standoff element being coupled to said attachment structure, and wherein said hinge joint is coupled to said inflatable support structure, so as to urge said hinged standoff elements into a spread apart state that places said tensionable material in tension as said energy-focusing surface.

3. An antenna structure according to claim 1, wherein said inflatable support structure has a generally torus configuration.

4. An antenna structure according to claim 1, wherein said tensionable material is generally mesh-configured.

5. An antenna structure according to claim 2, wherein said hinge joint of said respective variable geometry standoff is coupled to said inflatable support structure by a connection element placed in tension by radial loading caused by inflation of said inflatable support structure.

6. An antenna structure according to claim 2, wherein said inflatable support structure has a cross-sectional diameter that is less than separation between locations of attachment of said tensionable material and said attachment structure in said spread apart state of said standoff elements.

7. An antenna structure according to claim 1, wherein said inflatable support structure is configured as an inflatable tubular hoop.

8. An antenna structure according to claim 1, further including a plurality of cords interconnecting said plurality of standoffs.

9. An antenna structure according to claim 8, wherein said plurality of cords include cords that cross-connect distal ends of hinged standoffs with hinge joints of adjacent hinged standoffs.

10. An antenna structure according to claim 8, wherein said plurality of cords include cords that cross-connect distal ends of said adjacent hinged standoffs.

11. An antenna structure according to claim 2, wherein said inflatable support structure is tubular configured and has a cross-sectional diameter that is less than separation between said spread apart hinged standoff elements.

12. A method of deploying an antenna structure comprising the steps of:

(a) attaching, to an inflatable support structure, a distribution of hinged standoffs each having a first and second standoff elements extending from a hinge joint therebetween, by means of connection elements that are placed in tension by inflation of said inflatable support structure and spreading apart of said hinged standoff elements;

(b) coupling said first standoff element to tensionable material which, when placed in tension, forms a focusing surface for energy incident thereon, and said second standoff element to a tensionable structure which, when placed in tension, forms an attachment structure for said tensionable material, a plurality of connections joining said flexible material with said tensionable structure; and (c) inflating said inflatable support structure to at least an extent necessary to increase separation between hinged standoffs of said distribution, so that said hinged standoff elements spread apart and place said tensionable material and said tensionable structure in tension, thereby said focusing surface for energy incident thereon.

13. A method according to claim 12, wherein said inflatable support structure is generally hoop-shaped and has a cross-sectional diameter that is less than the spacing between said spread apart hinged standoff elements.

14. A method according to claim 13, wherein a plurality of cords interconnect selected ones of said plurality of hinged standoffs, and are placed in tension by inflating said inflatable support structure.

15. A method according to claim 14, wherein said flexible material comprises generally mesh-configured material that is reflective to electromagnetic energy incident thereon.

16. An antenna structure comprising:

a collapsible energy focusing structure which, when placed in tension, conforms with a prescribed geometrical shape and forms a surface having an energy-focusing contour for electromagnetic energy incident thereon;

a generally hoop-shaped inflatable support structure; and a distribution of variable geometry tensioning elements, which attach said collapsible energy focusing structure to said generally hoop-shaped inflatable support structure, and which are configured to effectively decouple the energy-focusing contour of the surface of said collapsible energy focusing structure from said generally hoop-shaped inflatable support structure, while employing radial loading support capability of said hoop-shaped inflatable structure to place in tension and thereby deploy said collapsible energy focusing structure.

17. An antenna structure according to claim 16, wherein a respective variable geometry tensioning element comprises a plurality of hinged spreader-standoff elements that are coupled to said generally hoop-shaped inflatable support structure, and are rotatable relative to each other, so as to maintain said collapsible energy focusing structure in tension, while accommodating variations in the shape of said generally hoop-shaped inflatable support structure.

18. An antenna structure according to claim 17, wherein said collapsible energy focusing structure comprises a tensionable antenna mesh and an associated tensionable catenary network of ties and cords arranged adjacent to said generally hoop-shaped inflatable support structure and supported in tension with said antenna mesh by said distribution of variable geometry tensioning elements, which attach said tensionable antenna mesh and said catenary network to said generally hoop-shaped inflatable support structure.

19. An antenna structure according to claim 18, wherein said generally hoop-shaped inflatable support structure comprises a hoop-configured tubular medium, to which said spreader-standoff elements are coupled at hinge joints of respective pairs of spreader-standoff elements by means of radial connection elements therebetween, which are retained in tension by inflation of said hoop-configured tubular medium, said spreader-standoff elements having lengths thereof that effectively span said inflatable tubular medium, and wherein the hinge joint of a respective spreader-standoff pair is located adjacent to an inner diameter side of said inflatable tubular medium, and generally distal attachment locations of said collapsible support structure of said spreader-standoff elements are located beyond an outer diameter side of said inflatable tubular medium.

20. An antenna structure according to claim 19, wherein cross-connect cords and ties of said tensionable catenary network are attached to distal locations of said spreader-standoff elements in such a manner that the extent to which said hinged spreader-standoff elements may spread apart is constrained by said cords and ties.

* * * * *